United States Patent [19]

Martin

[11] Patent Number: 4,571,527

[45] Date of Patent: Feb. 18, 1986

[54] VFET DRIVING CIRCUITS FOR PLASMA PANEL DISPLAY SYSTEMS

[75] Inventor: William J. Martin, San Jose, Calif.

[73] Assignee: International Business Machines Corporation, Armonk, N.Y.

[21] Appl. No.: 675,259

[22] Filed: Nov. 27, 1984

Related U.S. Application Data

[63] Continuation of Ser. No. 431,864, Sep. 30, 1982, abandoned.

[51] Int. Cl.[4] ..... H05B 37/02

[52] U.S. Cl. ..... 315/169.4; 315/209 R; 315/216; 315/240

[58] Field of Search ..... 315/169.4, 209, 216, 315/240

[56] References Cited

U.S. PATENT DOCUMENTS

| | | | |
|---|---|---|---|
| 3,619,659 | 11/1971 | Greenwood et al. | 307/263 |
| 3,675,043 | 7/1972 | Bell | 307/475 |
| 3,742,294 | 6/1973 | Wojcik | 315/169.4 |
| 3,772,607 | 11/1973 | Luckett | 307/475 |
| 3,919,591 | 11/1975 | Criscimagna | 315/169 |
| 3,924,143 | 12/1975 | Cunningham et al. | 307/263 |
| 3,958,136 | 5/1976 | Schroeder | 307/475 |
| 3,973,253 | 8/1976 | Criscimagna | 340/324 |
| 4,072,937 | 2/1978 | Chu | 340/324 |
| 4,097,856 | 6/1978 | Lamoureux | 340/324 |
| 4,189,729 | 2/1980 | Baker et al. | 340/777 |
| 4,200,822 | 4/1980 | Miller . | |
| 4,263,534 | 4/1981 | Martin | 315/169.4 |
| 4,316,123 | 2/1982 | Kleen et al. | 315/169.4 |

FOREIGN PATENT DOCUMENTS 106942 2/1984 European Pat. Off. .

OTHER PUBLICATIONS

Gas Panel Selection Circuit with Field Effect Transistors by Larsen and Wood; IBM Tech. Discl. Bull., vol. 18, No. 4, Sep. 1975, pp. 1071, 1072.

IBM Technical Disclosure Bulletin, vol. 21, No. 9, 2/79, "Magnetically Controlled Sustain Driver", to W. J. Martin, et al., pp. 3675–3676.

*Primary Examiner*—Harold Dixon

*Attorney, Agent, or Firm*—James A. Kunkle; Joseph J. Connerton; Joseph F. Villella

[57] ABSTRACT

A driving system for a plasma panel display which uses VFETs for output switches controls the transition time of an output waveform to a constant time. Transformerless circuitry for communicating low voltage digital logic signals across a floating boundary to VFET control circuitry is provided. Low voltage control circuitry is isolated from high voltage sources by semiconductor circuitry which eliminates the need for transformer isolation techniques. In an alternative embodiment, the transition of an output waveform is controlled at a constant slew rate.

6 Claims, 8 Drawing Figures

VFET DRIVING CIRCUITS FOR PLASMA PANEL DISPLAY SYSTEMS

This is a continuation of Application Ser. No. 431,864 filed Sept. 30, 1982, now abandoned.

DESCRIPTION

1. Technical Field

This invention relates to circuits for driving conductor arrays in an AC plasma display system.

2. Background Art

In conventional AC plasma display systems, arrays of parallel conductors are disposed orthogonally to each other on opposite sides of a gas filled panel, the intersections of the conductor arrays forming gas cells. The gas cells may be selectively ionized by application of discharge voltages in order to produce a visual display having a specific configuration and information content. When discharged, the cells produce a wall charge voltage which combines with a lower level sustain signal.

Plasma display systems are provided with circuitry for producing the sustain signal, composed of a periodic voltage, which is used to continuously discharge the gas cells at a frequency sufficient to maintain the discharge. By so doing, the specific configuration and information content of the visual display is maintained in its then present state. The sustain signal is also used to normalize a write or an erase operation. The peak sustain voltage is typically on the order of 200 volts.

The generation of the high voltage sustain signals is controlled by low voltage circuitry which is responsive to digital logic signals from an external processor or controller, the content of the digital logic signals being dependent on the operation required of the plasma system. Since the sustain signals and the digital logic signals are a different voltage levels, means must be provided for communicating between these signals in order to operate the plasma system. One method of providing such communication is shown in U.S. Pats. Nos. 3,973,253 and 4,097,856 which employ pulse transformers for communicating a low voltage signal to a high voltage signal while simultaneously providing isolation between the high and low voltage circuitry. It would be desirable to eliminate the use of pulse transformers and replace them with low cost semiconductor circuitry.

One problem associated with the use of plasma display systems is controlling the transition times of a switched waveform such as the sustain voltage. Techniques are available for controlling the transition times at low slew rates; however, it becomes increasingly difficult to do so as the slew rates and operating voltages required to drive an AC plasma panel display system increase. The problem becomes particularly pronounced when high power vertical field effect transistors (VFETs) are employed in the plasma panel driving circuits. High power VFETs exhibit wide bandwidth characteristics making them prone to oscillation if their gate drive circuitry does not have an even higher frequency response. VFETs also have a very high input capacitance (typically on the order of 1200 pF) which necessitates the use of low impedance drive circuitry. Additionally, there is a variation in gain from one device to another, thus requiring a different gate to source input from one device to another in order to obtain the same output slew rate.

Previous plasma panel driving circuits have made little attempt to control the transition times, i.e., rise amd fall times, of a switched waveform such as the sustain voltage. Instead, these circuits have been designed to provide a transition time that is as fast as possible. In large plasma panels, very fast transition times cause high currents to flow through the system components. It would be most desirable to control the transition time of a switched waveform such as the sustain voltage, to a constant time, or alternatively to a constant slew rate.

Accordingly, it is an object of this invention to provide improved driving circuitry in a plasma panel display system.

It is another object of this invention to provide circuitry for producing a switched waveform such as the sustain voltage in a plasma panel display system, wherein the transition time of the switched waveform is controlled to a constant time.

It is a further object of this invention to provide circuitry for producing a switched waveform, such as the sustain voltage in a plasma panel display system, wherein the transition time of the switched waveform is controlled to a constant slew rate.

It is still another object of this invention to replace transformers used in conventional plasma panel display systems for isolating low voltage control circuitry from high voltage pulse circuitry with low cost semiconductor circuitry.

It is yet a further object of this invention to replace transformers used in conventional plasma panel display systems for communicating digital logic signals across a floating boundary to low voltage control circuitry with low cost semiconductor circuitry.

DISCLOSURE OF THE INVENTION

This invention provides circuitry for driving a plasma panel display system wherein the transition time of the sustain waveform is controlled to a constant time. The transition time is set to a constant time independent of the varying voltage through which the circuitry might transit. Vertical Field Effect Transistors (VFETs) are used as the output switches for providing the periodic sustain voltage to the gas cells in the plasma panel display system. The source of some of the VFETs can float up and down when the VFETs are not in use, and the gate of these VFETs remains connected with its source when the VFET is not in use. The low voltage circuitry used to drive the VFETs also floats with the source potential.

The transformers conventionally used to communicate digital logic signals from an external controller or processor to the floating low voltage drive circuitry are replaced with low cost semiconductor circuitry. In this manner, the digital logic signals are communicated directly to the low voltage drive circuitry across a high voltage boundary without the need for transformers.

In an alternative embodiment, the transition time of the sustain waveform is controlled to a constant slew rate.

BEST MODE FOR CARRYING OUT THE INVENTION

Figure 1:
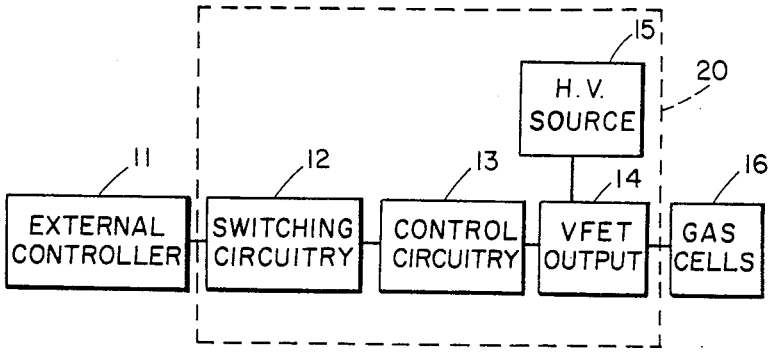
FIG. 1 is a block diagram of a driving system for a plasma panel display system constructed in accordance with the present invention.

Referring to FIG. 1, the driving system 20 of the present invention contains switching circuitry 12 for receiving digital logic signals (typically TTL levels are used) from an external controller 11 or an external processor (not shown). These logic signals are used only for control purposes; i.e., to control the sustain operation of the plasma panel. They do not provide information which is to be displayed on the screen of the plasma panel.

Switching circuitry 12 receives the incoming digital logic signals and then communicates the information provided by these signals to control circuitry 13. It is control circuitry 13 which sets the transition time of the sustain waveform which is provided by VFET output 14 to gas cells 16. Control circuitry 13 comprises low voltage gate drive circuitry for driving the gate of VFET 14, a current source, and gate isolation circuitry for isolating high voltage source 15 from the low voltage gate drive circuitry. These functions will be explained in more detail with relation to FIGS. 3–7.

Figure 2:
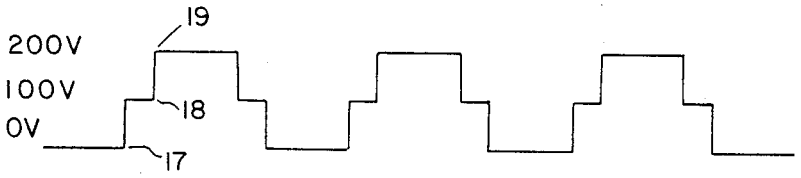
FIG. 2 is a diagram of a switched waveform such as one produced by the instant invention.

An example of the sustain waveform which is provided by VFET output 14 to gas cells 16 is shown in FIG. 2. As described more fully in U.S. Pat. No. 4,263,534, 200 volt VFETs having characteristics which make the devices useable in plasma panels are not readily available. Thus, to obtain a 200 volt peak-to-peak waveform, circuitry must be designed containing two stages with each stage employing 100 volt VFETs. The first stage provides a 0–100 volt peak-to-peak swing as shown by points 17 and 18 in the sustain waveform shown in FIG. 2. The output of the first stage is then input to the second stage so that the second stage will provide a voltage swing from 100 to 200 volts as shown by points 18 and 19 in FIG. 2. Taken together, the two stage circuitry provides a 200 volt peak-to-peak waveform.

The term "transition time" as defined herein refers to either the rise time or the fall time. The rise times that are controlled by the present invention are the rise times of the individual stages, i.e., the circuits disclosed herein control the rise time of the sustain waveform from 0–100 volts, corresponding to the first stage of a 0–200 volt circuit and from 100–200 volts, corresponding to the second stage of a 0–200 volt circuit. Rise time, as defined herein, is the time it takes for a waveform to rise from 10% of its maximum value to 90% of its maximum value. Likewise, the fall times that are controlled by the present invention are the fall times of the individual stages. Fall time, as defined herein, is the time it takes for a waveform to fall from 90% of its maximum value to 10% of its maximum value.

Two other terms, "rising edge" and "falling edge", refer to the leading and trailing edges of the signals which rise and fall respectively. The rising edge is that part of the waveform that begins at the lowest point on the waveform and ends at the highest point; the falling edge is that part of the waveform that begins at the highest point on the waveform and ends at the lowest point. The rising edge has a positive slope while the falling edge has a negative slope.

Figure 3:
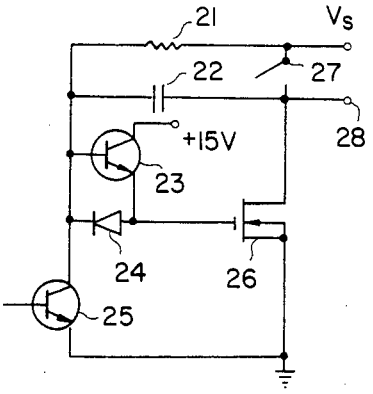
FIG. 3 is a schematic of a ground referenced circuit which controls the fall time of the output waveform to a constant time according to the present invention.

FIG. 3 is a schematic of a circuit which enables the fall time of a switched waveform to be controlled to a constant time. The source of VFET 26 is connected to ground potential, while the drain is connected to the output terminal 28. When the base of transistor 25 is held low, transistor 23 turns on and drives the gate of VFET 26, thus turning the device ON. When the base of transistor 25 goes high, it is turned ON. By so doing, the base of transistor 23 is pulled down to approximately ground potential turning transistor 23 OFF, thus removing the drive current to the gate of VFET 26, whereby VFET 26 is turned OFF. Switch 27 represents a connection to another circuit which will be discussed in detail in relation to FIG. 8.

The current used to drive the gate of VFET 26 is provided from a current source consisting of resistor 21 connected between the high voltage supply $V_s$ (typically 100 volts) and approximately ground potential. Since the value of high voltage supply $V_s$ will typically fluctuate, the current source will likewise vary as the value of $V_s$. The second terminal of resistor 21 is connected to the base of transistor 23 whereby this terminal will thus be above ground potential by an amount equal to the base-emitter voltage of transistor 23 plus an amount dependent on the transconductance, gm, of VFET 26. As the transconductance of VFET 26 changes, the gate to source voltage changes. Note that the transconductance, $g_m$ may be approximated as the gain of VFET 26 containing a term dependent on the gate to source voltage. As the gate to source voltage changes, the voltage across resistor 21 changes and likewise the current through resistor 21. Compared to the value of the high voltage supply; i.e., 100 volts, this change in voltage is negligible.

The current supplied by this current source will be split between the base of transistor 23 and capacitor 22. As output node 28 moves toward ground potential, capacitor 22 begins to draw more current from the base of transistor 23. In this manner, the current through capacitor 22 acts as a feedback control to regulate the amount of drive current supplied to the gate of VFET 26. The feedback crurent used to control drive current to the gate of VFET 26 is equal to the value of capacitor 22 multipled by the change in voltage with time, i.e., $I=C\,dv/dt$. The value of capacitor 22 is a constant. As noted above, the supply current is a function of supply voltage Vs, namely Vs/R, where R is the value of resistor 21. Since the gain of transistor 23 is chosen to be quite high, the value of the base current supplied to transistor 23 will be small compared to the current drawn by capacitor 22. As a good approximation, the current through resistor 21 will be equal to the current through capacitor 22. Substituting the value of the current through resistor 21 into the above equation gives $Vs/R=C\ dv/dt$. If dv now represents a transition through the entire $V_s$ range, then $dv=V_s$ and thus $dt=R \times C$, where C is the value of capacitor 22. Thus the fall time of the output voltage is set to a constant time which is independent of the varying voltage through which the circuit might transit.

Figure 4:
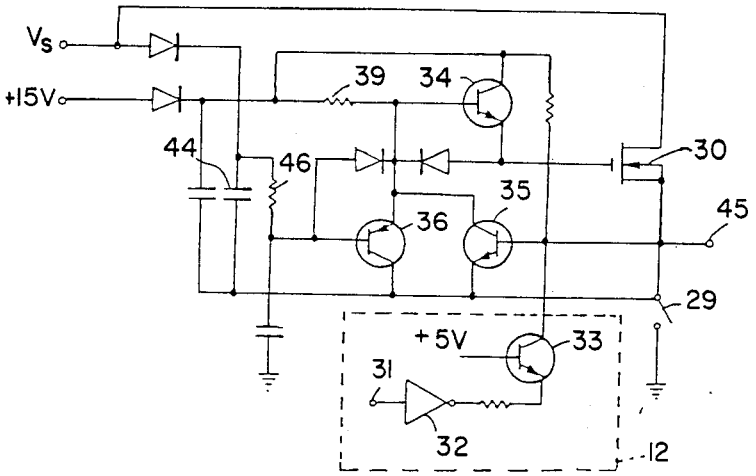
FIG. 4 is a schematic of a floating reference circuit which controls the rise time of the output waveform to a constant time and which provides isolation between the input switching circuit and the floating low voltage circuitry according to the present invention.

FIG. 4 is a modified version of the fall time control circuitry of FIG. 3, which also incorporates switching circuitry 12 for receiving digital logic signals from an external controller or processor via terminal 31. Transistors 34 and 35 perform the same functions as transistors 23 and 25 in FIG. 3 while resistor 46 and capacitor 44 perform the same functions as resistor 21 and capacitor 22 in FIG. 3. The gain of transistor 34 tends to be small, so transistor 36 is added to boost the gain of transistor 34. In this manner, sufficient current is supplied to the gate of VFET 30 to turn that device ON. In this circuit, the source of VFET 30 is output terminal 45. Capacitor 44, which has approximately the supply voltage $V_s$ across it and resistor 46, provides a current source equal to $V_s$ volts divided by the value of resistor 46. In actuality, resistor 46 has one terminal connected to a first terminal of capacitor 44 and the other terminal connected to the base of transistor 36 whereby the base of transistor 36 serves as the reference point with respect to the voltage across resistor 46. Switch 29 represents a connection to another circuit which will be explained in more detail in relation to FIG. 8.

Switching circuitry 12 in FIG. 4 comprises inverter 32 and transistor 33 which is connected in the common base configuration such that the source of VFET 30 floats when the device is not being used. The source voltage floats up and down between 0 and $V_s$ volts when the device is not in use whereby the control circuitry which drives VFET 30 must also float. Therefore, digital logic signals must be communcicated across a floating boundary. Although shown here as an inverter in the preferred embodiment, any type of logical gate may be used to receive the digital logic signals at input node 31.

Transistor 33 functions as a switched current source to communicate the digital logic signals (typically, TTL referenced to ground) up to the floating fall time control circuitry. When an up level signal is applied to inverter 32 at terminal 31, transistor 33 turns ON. This, in turn, holds transistor 35 OFF, allowing enough of the current through resistor 39 to be directed to the base of transistor 34 so as to turn that device ON. By so doing, sufficient drive current is provided to the gate of VFET 30 to turn the device ON.

Figure 5:
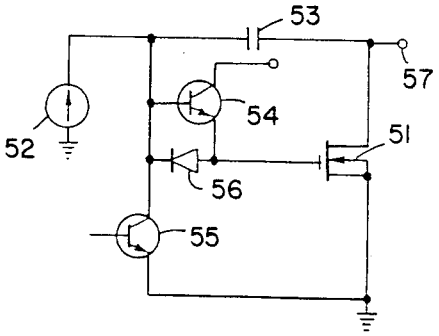
FIG. 5 is a schematic of a circuit which controls the falling edge of the output waveform to a constant slew rate according to the present invention.

FIG. 5 is a schematic of a circuit that enables the falling edge of a switched waveform to be controlled to a constant slew rate. The source of VFET 51 is connected to ground potential, while the drain serves as output terminal 57. When the base of transistor 55 is held low, transistor 54 turns on and drives the gate of VFET 51, thus turning that device ON. When the base of transistor 55 goes high, it is turned ON. By so doing, the base of transistor 54 is pulled down to approximately ground potential turning trransistor 54 OFF, thus providing no drive current to the gate of VFET 51.

The slew rate dv/dt, i.e., the change in the output voltage at terminal 57 with time, is equal to the feedback current used to drive the gate drive circuitry of VFET 51 divided by the value of capacitor 53. The current used to drive VFET 51 is provided from a constant current source 52. The value of capacitor 53 is fixed. Since the value of the current supplied to the gate control circuitry of VFET 51 is constant, then the slew rate dv/dt will be constant. This means that the falling edge of the output voltage, i.e., the sustain waveform, is controlled at a constant slew rate. Thus the falling edge of the sustain waveform will be fixed to a constant slew rate, i.e., have a constant slope even when the output voltage changes value. An incremental change in dv will be offset by an incremental change in dt so as to maintain a constant dv/dt value.

Figure 6:
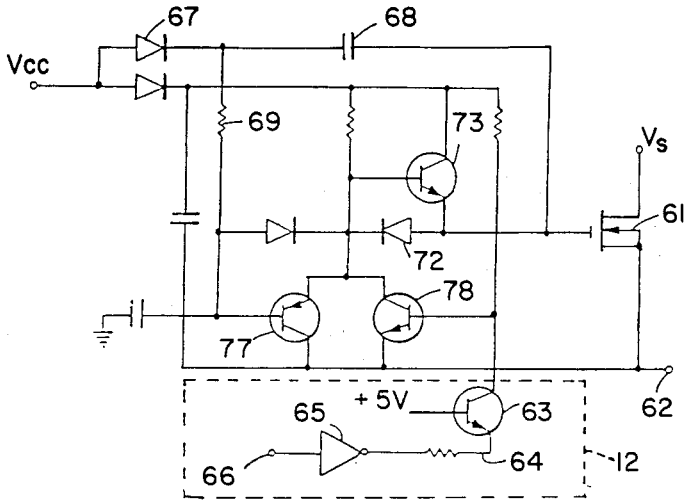
FIG. 6 is a schematic of a circuit which controls the rising edge of the output waveform to a constant slew rate and which provides isolation between the input switching circuit and the floating low voltage circuitry according to the present invention.

FIG. 6 is a modified version of the falling edge control circuitry of FIG. 5 which also incorporates switching circuitry 12 for receiving digital logic signals from an external controller or processor. Transistors 73 and 78 perform the same functions as transistors 54 and 55 in FIG. 5 to supply sufficient current to the gate of VFET 61 to turn that device ON. In this circuit, the source of VFET 61 is the output terminal 62. The operation of the switching circuitry 12 in FIG. 6 is identical to that explained heretofore in relation to FIG. 4.

The circuit of FIG. 6 has a constant current source different than the current source used in FIG. 4. When transistor 78 is turned ON (holding VFET 61 OFF) and the source of VFET 61 is at ground, capacitor 68 is charged from Vcc through diodes 67 and 72 to a D.C. voltage level equal to Vcc minus the voltage drops across diodes 67 and 72 and the saturation voltage of transistor 78. When transistor 73 is turned ON, the charge on capacitor 68 is driven up by the emitter of transistor 73 whereby the current through resistor 69 is equal to the voltage across capacitor 68 minus the base-emitter voltage of transistor 77 plus the base-emitter voltage of transistor 73, divided by the value of resistor 69. Since the base-emitter voltages of transistors 73 and 77 are approximately equal, the current through resistor 69 is equal to the voltage across capacitor 68 divided by the value of resistor 69. In this manner, a constant current source is created.

Figure 7:
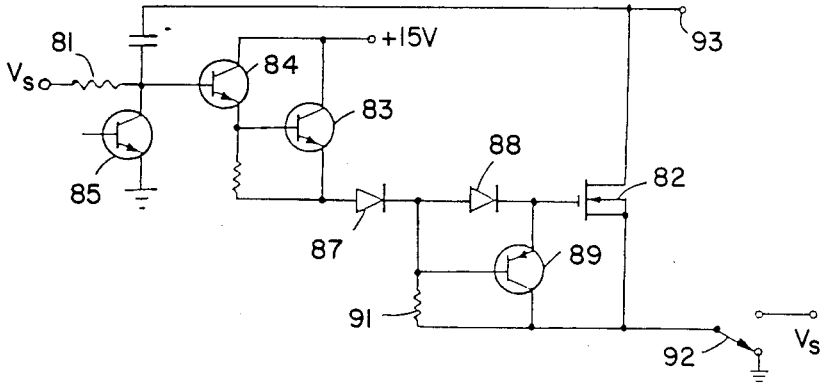
FIG. 7 is a schematic of a circuit according to the instant invention which incorporates isolation between the low voltage driving circuitry and the high voltage output circuitry.

The circuit shown in FIG. 7 is a modification of the circuit in FIG. 3 which additionally encompasses gate control isolation circuitry for isolating the low voltage gate control circuitry from a high voltage source. The drain of VFET 82 is the output terminal 93. When switch 92 is in the $V_s$ position, diode 87 is reverse biased and provides isolation between the high voltage $V_s$ and the low voltage gate drive circuitry which comprises transistors 83, 84, and 85 as well as the current source formed by the connection of resistor 81 between voltage supply $V_s$ and the base of transistor 84. At this time, it is desired to hold VFET 82 OFF which requires keeping the gate of VFET 82 from reaching a voltage level sufficient to turn the device ON. The gate voltage of VFET 82 equals the sum of the source voltage of VFET 82, the base-emitter voltage of transistor 89, and the voltage across resistor 91. The only one of these terms that is controllable is the voltage across resistor 91. It would be prohibitively difficult to make a resistor with such a low resistance that the voltage developed across it would be small enough to hold VFET 82 OFF. Since diode 88 is reverse biased, the current through resistor 91 consists entirely of the base current of transistor 89. Since the emitter current of a transistor is equal to the gain of the transistor times the base current of the transistor, the voltage developed across resistor 91 is equal to the emitter current of transistor 89 times the value of resistor 91 divided by the gain of transistor 89. By choosing a large enough gain for transistor 89, the voltage across resistor 91 can be kept at a low level without requiring the value of resistor 91 to be prohibitively small.

When switch 92 is in the ground position, both diodes 87 and 88 are forward biased so transistor 89 is held off. At this time, the circuit functions the same as the one described in relation to FIG. 3.

Figure 8:
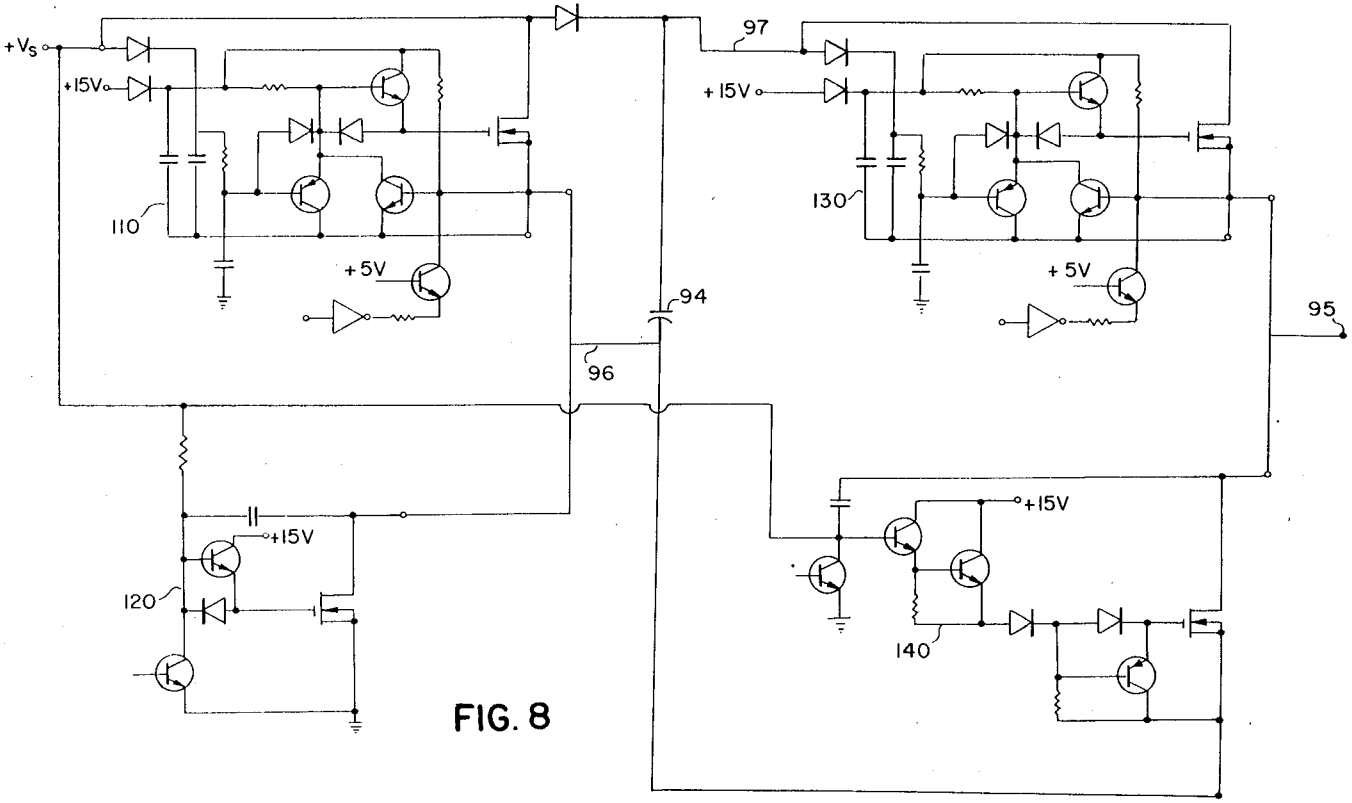
FIG. 8 is a schematic of a complete driving system for a plasma panel display system which uses the circuits of the present invention.

FIG. 8 shows a complete embodiment of a driving system for providing a constant rise time of a 200 volt peak-to-peak sustain voltage. The driving system shown in FIG. 8 encompasses the circuits in FIGS. 3, 4, and 7, the details of which have been described supra.

Circuit 120 in the lower left-hand portion of FIG. 8 is identical to the circuit of FIG. 3, circuit 140 in the lower right-hand portion of FIG. 8 is identical to the circuit of FIG. 7, and the two circuits 110, 130 in the upper portion of FIG. 8 are each identical to the circuit of FIG. 4. In addition, it can be seen that the pictorial switch element 27 (FIG. 3) has been replaced with circuit 110, the pictorial switch element 92 (FIG. 7) has been replaced with the series combination of circuits 120 and 110, and the pictorial switch element 29 (FIG. 4) has been replaced by circuits 120 and 140 for circuits 110 and 130, respectively.

Initially, circuits 110 and 130 are OFF and circuits 120 and 140 are ON. At this time, line 96 is pulled down to ground. Thus capacitor 94 has 100 volts across it and line 97 is at 100 volts. Line 95 which is output to the plasma cells is now at ground potential. When circuit 120 turns OFF and circuit 110 turns ON, line 96 is pulled up to 100 volts causing line 97 connected to the top terminal of capacitor 94 to be pulled up to 200 volts. Capacitor 94 still has 100 volts across it. Line 97 thus provides a 200 volt source to circuit 130. By so doing, line 95 outputs 100 volts to the gas cells. When circuit 140 turns off and circuit 130 turns on, line 95 outputs 200 volts to the gas cells. Thus, the circuitry shown in FIG. 8 provides a 0–200 volt output signal comprising a first stage which generates a 0–100 volt output signal, and a second stge which generates a 0–100 volt signal referenced to the output of the first stage such that output line 95 provides a 0–200 volt ground referenced signal to the gas cells.

In other words, when circuit 100 turns ON and circuit 120 turns OFF, the voltage across circuit 110 experiences a controlled fall time by the function of circuit 100 described above with reference to FIG. 4. The controlled fall time of the voltage across circuit 110 manifests itself as a controlled rise time of the voltage on line 96 and, since circuit 140 is still ON, the controlled rise of line 96 results in a controlled rise time of the voltage on line 95 from ground potential to $V_S$. This transition is the transition from point 17 to point 18 shown in FIG. 2. At the same time, line 97, being initially at a potential equal to $V_S$, rises to a potential of $2V_S$ because the voltage across capacitor 94 cannot change at a rapid rate.

In order to cause the voltage on line 95 to rise in a controlled time from the voltage $V_S$ to the voltage $2V_S$ (i.e., from point 18 to point 19 in FIG. 2), circuit 140 turns OFF, and circuit 130 turns ON.

When circuit 130 turns ON, the voltage across circuit 130 experiences a controlled fall time by the function of circuit 130 described above with reference to FIG. 4. The controlled fall time of the voltage across circuit 130 manifests itself as a controlled rise time of the voltage on line 95 from $V_S$ to $2V_S$ thereby completing the rise from ground potential to 200V ($2V_S$) shown in FIG. 2.

The falling edges of the sustain voltage shown in FIG. 2 are produced by reversing the above described switching sequence of the circuits of FIG. 8. The falling edge from 200V to 100V results from circuit 140 turning ON while circuit 130 turns OFF. And the falling edge from 100V to 0V results from circuit 120 turning ON while circuit 110 turns OFF. The transition times of the falling edges are also controlled by the function of circuits 120 and 140 described above with reference to FIGS. 3 and 7, respectively.

While the invention has been particularly shown and described with reference to a preferred embodiment thereof, it will be understood by those skilled in the art that the foregoing and other changes in form and detail may be made therein without departing from the spirit and scope of the invention.

What is claimed is:

1. A system for suppying a sustain voltage to a display device having a plurality of discharge cells comprising, in combination:

a first switch circuit including a first FET having a drain connected to a high voltage, a source connectable to an output connection to said display device, and having a gate;

a second switch circuit including a second FET having a drain connected to the source of said first FET through a first junction and a source connected to ground potential, and having a gate;

a third switch including a third FET having a gate and having its source connected to said output connection and its drain connectable to said high voltage through a second junction;

a fourth switch including a fourth FET having a gate and having its drain connected to said output connection and its source connected to said first junction;

a diode having its anode connected to said high voltage and its cathode connected to said second junction which connects to the drain of said third FET;

a capacitor connected between said first and second junctions;

a control means connected to said FET gates for operating said switches to place the system in one of multiple states;

a first state having the 2nd and 4th FETs conducting and the 1st and 3rd FETs non-conducting to complete a charging connection to said capacitor from the high voltage to ground to charge said capacitor to the level of said high voltage and also providing a ground voltage level at said output connection;

a second state having the 2nd and 3rd FETs non-conducting and the 1st and 4th FETs conducting to complete a circuit from said high voltage to said output connection through said 1st and 4th switches to provide said high voltage at said output connection;

a third state having said 1st and 3rd FETs conducting and said 2nd and 4th FETs non-conducting to complete a circuit to place the high voltage in series with said capacitor which has been charged to said high voltage level by said 1st state wherein a signal of twice the amplitude of said high voltage level is provided at said output connection.

2. A system as recited in claim 1 further comprising:

the switching of said 1st FET from a non-conducting to a conducting state occurring at a substantially constant transition time;

the switching of the 2nd FET from a conducting to a non-conducting state occurring substantially simultaneously with the switching of said 1st FET;

whereby, the voltage on the source of said 1st FET rises in a constant time during the voltage transition of said 1st FET.

3. A system as recited in claim 1 further comprising:

the switching of said 3rd and 4th FETs occurring after the switching of said 1st and 2nd FETs;

whereby the voltage at said output connection rises in a constant time from substantially ground potential to a voltage substantially equal to said high voltage and after a predetermined time rises in a constant time to a voltage substantially equal to twice the level of said high voltage.

4. A system as recited in claim 1 wherein said control means connected to said first and second FETs each comprise:

a logic gate having an input for receiving digital logic signals;

a switchable current source connected to and switchable by the output of said logic gate and connected to the gate of the respective FET;

whereby, said logic signals applied to said logic gate switch said current source which, in turn, switches the respective FET.

5. A system as recited in claim 4 wherein said switchable current source comprises:

a bipolar transistor having an emitter connected to the output of said logic gate, a collector connectable to the gate of the respective FET, and a base connected to a voltage source.

6. A system as recited in claim 5 wherein said 1st, 3rd and 4th switch circuit means electrically float after said 2nd switch circuit means is switched from a conducting to a non-conducting state.

* * * * *